US008870336B2

(12) United States Patent
Tamura

(10) Patent No.: US 8,870,336 B2
(45) Date of Patent: Oct. 28, 2014

(54) IMAGE-FORMING DEVICE AND MEDIUM EDGE PART JUDGMENT METHOD

(71) Applicant: Seiko Epson Corporation, Tokyo (JP)

(72) Inventor: Yosaku Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/851,422

(22) Filed: Mar. 27, 2013

(65) Prior Publication Data

US 2013/0257973 A1 Oct. 3, 2013

(30) Foreign Application Priority Data

Mar. 28, 2012 (JP) ..... 2012-073229

(51) Int. Cl.
*B41J 29/393* (2006.01)

(52) U.S. Cl.
USPC ..... 347/19; 347/16; 347/14

(58) Field of Classification Search
USPC ..... 347/5, 9, 14, 16, 19
See application file for complete search history.

(56) References Cited

U.S. PATENT DOCUMENTS

| | | | | |
|---|---|---|---|---|
| 2005/0058495 | A1 | 3/2005 | Sakai et al. | |
| 2007/0097165 | A1 * | 5/2007 | Niioka | 347/19 |
| 2008/0225075 | A1 * | 9/2008 | Nishizaka | 347/19 |
| 2009/0225376 | A1 | 9/2009 | Horade | |
| 2010/0026738 | A1 | 2/2010 | Saikawa et al. | |
| 2010/0171785 | A1 * | 7/2010 | Endo | 347/16 |

FOREIGN PATENT DOCUMENTS

| | | | |
|---|---|---|---|
| JP | 06-032032 | A | 2/1994 |
| JP | 2005-081750 | A | 3/2005 |
| JP | 2005-096991 | A | 4/2005 |
| JP | 2008-049653 | A | 3/2008 |
| JP | 2008-238700 | A | 10/2008 |
| JP | 2009-155013 | A | 7/2009 |
| JP | 2010-030752 | A | 2/2010 |

* cited by examiner

*Primary Examiner* — Lam S Nguyen
(74) *Attorney, Agent, or Firm* — Global IP Counselors, LLP

(57) ABSTRACT

To detect an edge part of a medium with accuracy although the medium includes a false detection element, more than one change point, which changes from a condition that an output of an optical sensor indicates existence of a print medium to a condition that the output indicates non-existence of the print medium, is detected while the optical sensor moved on the print medium along a main scanning direction. A right edge part candidate detection process and a left edge part candidate process are performed to detect at points immediately before output changes as the right and left edge part candidates of the medium when the output of the optical sensor continuously indicates a condition of non-existence of the medium while the optical sensor and the print medium are moved further along the main scanning direction for a predetermined distance from the detected change points.

8 Claims, 7 Drawing Sheets

IMAGE-FORMING DEVICE AND MEDIUM EDGE PART JUDGMENT METHOD

CROSS-REFERENCE TO RELATED APPLICATIONS

This application claims priority to Japanese Patent Application No. 2012-073229 filed on Mar. 28, 2012. The entire disclosure of Japanese Patent Application No. 2012-073229 is hereby incorporated herein by reference.

BACKGROUND

1. Technical Field

The present invention relates to an image-forming device and a medium edge part judgment method.

2. Background Technology

In image-forming devices that form an image on a medium such as a paper, it is well known to detect an edge part of the medium. For example, Patent document 1 discloses an image-forming device that includes a carriage which moves in a width direction of the medium, a recording head mounted on the carriage, and a paper width detection sensor. In this image-forming device, as a paper width detection sensor, an optical sensor is used to detect existence or non-existence of a medium based on an output in response to the light intensity by detecting the reflection light of the irradiated light. And, while the carriage moves in a main scanning direction, the output from the paper width detection sensor compares with a threshold value, and when the output changes and exceeds the threshold value, the change point is identified as an edge part of the medium.

Japanese Laid-open Patent Publication No. 2009-155013 (Patent Document 1) is an example of the related art.

SUMMARY

Problems to Be Solved by the Invention

However, in the image-forming device described in Patent document 1, when a medium included a false detection element such as an image or a hole, even though the optical sensor scanned on the medium, the light intensity of the reflection light changed and there was a case that the edge part of the medium was detected erroneously. In recent years, for example, in a business field, there is a case that a medium (e.g. a preprint paper) including a false detection element such as an image (e.g., a company name, or the like) or a hole (e.g., a punch hole, or the like) is used for forming an image and it desired to detect an edge part of a medium with accuracy although a medium includes such a false detection element.

Having regard to the above advantage, the invention has a main advantage that is to accurately detect an edge part of a medium although the medium includes a false detection element.

Means Used to Solve the Above-Mentioned Problems

A first image-forming device of the invention includes a recording means that forms an image on a medium; an optical sensor that outputs an output value in response to existence or non-existence of the medium; a first moving means that is relatively movable for the optical sensor and the medium by moving at least one of the optical sensor and the medium in a predetermined first direction; an edge part candidate detection means that performs an edge part candidate detection process for detecting at a point immediately before output changes as an edge part candidate of the medium when more than one change point, which changes from a condition that the output of the optical sensor indicates an existence of the medium to a condition that the output of the optical sensor indicates a non-existence of the medium while the optical sensor and the medium are relatively moved by the first moving means, is detected, and the output of the optical sensor continuously indicates non-existence of the medium while the optical sensor and the medium are relatively moved further along the first direction for a predetermined moving amount from the detected change points; and an edge part judgment means that performs an edge part judgment process to judge an edge of the medium based on the detected edge candidate.

In the first image-forming device of the invention, first, it performs an edge part candidate detection process for detecting at a point immediately before output changes as an edge part candidate of the medium when more than one change point, which changes from a condition that the output of the optical sensor indicates existence of the medium to a condition that the output of the optical sensor indicates non-existence of the medium, is detected while the optical sensor and the medium are relatively moved along the predetermined first direction, and the output of the optical sensor continuously indicates non-existence of the medium while the optical sensor and the medium are relatively moved further along the first direction for a predetermined moving amount from the detected change point. Next, it performs the edge part judgment process to judge an edge of the medium based on the detected edge candidate. In this way, even when there is a false detection element in the medium so as to change from a condition that the output of the optical sensor indicates an existence of the medium to a condition that the output of the optical sensor indicates a non-existence of the medium, if it does not continue a condition indicating the non-existence of the medium, the change point is not detected as an edge part candidate of the medium. On the other hand, when an actual edge part of the medium is detected as a change point, it continues a condition that the output indicates the non-existence of the medium after the optical sensor moved to outside from the edge part of the medium so that it is easy to detect the actual edge part of the medium as the edge part candidate. Because of this, an edge part of a medium can be detected with accuracy although the medium includes a false detection element so that it is more accurate when compare to a case that the change point, which changes the output of the optical sensor, is simply detected as an edge part of a medium. Here, the phrase "a point immediately before output changes is detected as an edge part candidate of a medium" means that information indicating a position (coordinate, or the like) of a point immediately before output changes can be detected as an edge candidate, or information indicating a moving amount from a moving start position to a point immediately before output changes by the first moving means (moving time, moving distance, a control amount of the first moving means, or the like) can be detected. In the first image-forming device of the invention, the edge part judgment means can judge the detected edge part candidate as an edge part of a medium without any change.

In the first image-forming device of the invention, when the edge part candidate shall be deemed as a correct edge part based on the edge part candidate, the edge part judgment means can perform a process to judge the edge part candidate as the edge part of the medium. Because of this, an edge part of a medium can be detected with accuracy although the medium includes a false detection element so that it is more accurate when compare to a case that the detected edge candidate is judged as an edge part of a medium without any change.

The first image-forming device of the invention further includes a second moving means that is relatively movable for the optical sensor and the medium by moving at least one of the optical sensor and the medium in a second direction, which intersects with the first direction; and a moving control means that performs a moving process for re-detection to control the second moving means so as to relatively move the optical sensor and the medium when the edge part candidate shall not be deemed as a correct edge part in the edge judgment process. The edge part candidate detection means performs the edge part candidate detection process for re-detection of an edge part candidate after the moving process for the re-detection, and the edge part judgment means performs the edge part judgment process based on the re-detected edge candidate. Because of this, when the edge part candidate shall not be deemed as a correct edge part of the medium in the edge part detection process, it can perform the edge part candidate detection process in an area different from the previous area of the medium because the optical sensor and the medium are relatively moved in the second direction. Thus, for example, even if the previous edge part candidate was a case that a false detection element was detected in the medium, it can be expected that an actual edge part of the medium is detected as a correct edge part candidate by performing the edge candidate detection process in an area different from the previous area at the time of the re-detection. Because of this, the edge part of the medium can be detected with accuracy although the medium includes a false detection element.

A second image-forming device of the invention includes a recording means that forms an image on the medium; an optical sensor that outputs an output value in response to existence or non-existence of the medium; a first moving means that is relatively movable for the optical sensor and the medium by moving at least one of the optical sensor and the medium in a first direction; a second moving means that is relatively movable for the optical sensor and the medium by moving at least one of the optical sensor and the medium in a second direction, which intersects with the first direction; an edge part candidate detection means that performs an edge part candidate detection process to detect an edge part candidate of the medium based on an output change of the optical sensor while the optical sensor and the medium are relatively moved by the first moving means; an edge judgment means that performs an edge judgment process to judge the edge part candidate as an edge part of the medium when the edge part candidate shall be deemed as a correct edge part based on the detected edge part candidate; and a moving control means that performs a moving process for re-detection to control the second moving means to relatively move the optical sensor and the medium when the edge part candidate shall be deemed as a correct edge part in the edge part judgment process. The edge part candidate detection means performs the edge part candidate detection process and re-detects an edge candidate after the moving process for re-detection, and the edge part judgment means performs the edge part judgment process based on the re-detected edge part candidate.

First, the second image-forming device of the invention performs the edge part candidate detection process to detect an edge part candidate of the medium based on an output change of the optical sensor while the optical sensor and the medium are relatively moved along the first direction. Next, the edge part judgment process is performed to judge an edge part candidate as an edge part of the medium when the edge part candidate shall be deemed as a correct edge part of the medium based on the detected edge part candidate. And, when the edge part candidate shall not be deemed as a correct edge part in the edge part judgment process, the moving process for re-detection is performed to control the second moving means so as to relatively move the optical sensor and the medium in the second direction, the edge part candidate detection process is performed to re-detect an edge part candidate, and the edge part judgment process is performed based on the re-detected edge part candidate. In this way, when the edge part candidate shall not be deemed as a correct edge part of the medium in the edge part judgment process, the edge part candidate detection process can be performed in an area different from the previous area in the medium because the optical sensor and the medium are relatively moved in the second direction. Thus, for example, when the previous edge part candidate was a case that a false detection element was detected in the medium, it can be expected that at the time of the re-detection, the edge part candidate detection process is performed in the area where the false detection element is not existed so that the edge part of the medium can be detected with more accuracy although the medium includes a false detection element.

In the second image-forming device of the invention, after the moving process for re-detection, as the edge part candidate detection process, the edge part candidate detection means detects more than one change point which changes from a condition that the output of the optical sensor indicates existence of the medium to a condition that the output indicates non-existence of the medium while the optical sensor and the medium are relatively moved by the first moving means, and when it is a condition that the output of the optical sensor continuously indicates non-existence of the medium while the optical sensor and the medium are relatively moved along the first direction for a predetermined moving amount from the detected change point, a process to detect a point immediately before output changes as an edge part candidate of the medium is performed so that the edge part candidate is re-detected. In this way, at the time of the re-detection of the edge part candidate, even if there is a false detection element in the medium and it changes from a condition that the output of the optical sensor indicates existence of the medium to a condition that the output indicates non-existence of the medium, after that, if it does not continue a condition of non-existence of the medium, the change point is not detected as the edge part candidate of the medium. On the other hand, when an actual edge part of the medium was detected as the change point, it continues a condition indicating non-existence of the medium after the optical sensor was moved to outside from the edge part of the medium so that it is easy to detect the actual edge part of the medium as the edge part candidate. Because of this, at the time of the re-detection, an edge part of a medium can be detected with accuracy although the medium includes a false detection element.

In the first image-forming device or the second image-forming device, when the edge part of the medium was judged in the edge part judgment process after the moving process for re-detection, the moving control means relatively moves the optical sensor and the medium in an opposite direction of the moving direction of the moving process for re-detection and moves in the same moving amount of the moving process for re-detection. In this way, even when the optical sensor and the medium are moved in the second direction for repeating the edge part candidate detection process and the edge judgment process, a position relationship of the optical sensor and the medium in the second direction can be returned to a condition of the previous movement. Thus, at the time of the subsequent process (e.g., image forming, or the like), it is not required to judge whether or not positions of the optical sensor and the medium in the second direction are relatively changed at the time of detecting the edge part of the medium. Because of this, the subsequent process can be efficiently performed. By the way, when the edge part of the medium was judged in the edge part judgment process after the moving process for re-detection and when the moving process for re-detection was performed more than one time, the moving control means relatively moves the optical sensor and the medium in a direction opposite from the moving process for re-detection and moves it for a total moving amount that sums the moving amount of a number of times of the moving process for re-detection.

In the first image-forming device or the second image-forming device, the edge part candidate detection means respectively detects both edges of the edge part candidates in the first direction of the medium, and when the both edges of the edge part candidates shall be deemed as correct edge parts based on the detected both edges of the edge part candidates, the edge part judgment means judges the both edges of the edge part candidates as the both edges of the edge parts of the medium. In this way, the both edges of the medium can be detected with accuracy although the medium includes a false detection element. In this case, when distances from a predetermined central position of the first direction of the medium to the both edges of the edge part candidates shall be deemed as an equal, the edge part judgment means judges that the both edges of the edge part candidates shall be deemed as correct edge parts of the medium, or when a distance of the both edges of the edge part candidates shall be deemed as an equal to a width in the first direction of the medium, the both edges of the edge part candidates shall be deemed as correct edge parts of the medium. In this way, it can appropriately judge whether or not the edge part candidate is the correct edge part of the medium. Here, the information "a predetermined central position of the first direction of the medium" or "width of the first direction of the medium" can be inputted from, for example, an external or the memory means equipped in the image-forming device of the invention can preliminary store the information. Also, it can be derived based on the information (e.g., size of a medium, classification, or the like) inputted from an external.

In the first image-forming device or the second image-forming device, when the edge part candidate shall be deemed to be the same position as a predetermined theoretical edge part defined based on a size of the medium, the edge part judgment means judges that the edge part candidate shall be deemed as a correct edge part of the medium. In this way, the edge part candidate can appropriately judge whether the edge candidate is a correct edge part of the medium. Here, the information "a predetermined theoretical edge part" can be inputted from, for example, an external, or the memory means equipped in the image-forming device of the invention can preliminary store the information. Also, it can be derived based on the information (e.g., size of a medium, classification, or the like) inputted from an external.

A first medium edge part judgment method of the invention uses an image-forming device, which includes an recording means that forms an image on a medium; an optical sensor that outputs an output value in response to existence or non-existence of the medium; and a first moving means that is relatively movable for the optical sensor and the medium by moving at least one of the optical sensor and the medium in a predetermined first direction, and the first medium edge part judgment method includes the steps of:

(a) an edge part candidate detection process step that detects a point immediately before output changes as an edge part candidate of the medium when more than one change point, which changes from a condition that the output of the optical sensor indicates an existence of the medium to a condition that the output of the optical sensor indicates a non-existence of the medium while the optical sensor and the medium are relatively moved by the first moving means, is detected, and the output of the optical sensor continuously indicates no medium while the optical sensor and the medium are relatively moved in a predetermined moving amount from the detected change point along the first direction; and (b) an edge part judgment process step that judges an edge part of the medium based on the detected edge candidate.

In the first medium edge part judgment method of the invention, even if there is a false detection element in the medium and it changes from a condition that the output of the optical sensor indicates existence of the medium to a condition that the output of the optical sensor indicates non-existence of the medium, if it does not continue a condition of indicating non-existence of the medium, the change point is not detected as an edge part candidate of the medium. On the other hand, when an actual edge part of the medium was detected as the change point, the optical sensor continuously indicates a condition of non-existence of the medium after moving outside of the edge part of the medium so that it is easy to detect the actual edge part of the medium as an edge part candidate. Because of this, an edge part of a medium having a false detection element can be accurately detected so that it is more accurate when compare to a case that the change point where the output of the optical sensor is changed is simply detected as an edge part of a medium. By the way, in the first medium edge part judgment method of the invention, various aspects of the first image-forming device of the invention as described above can be employed and also, the steps that realize the respective functions of the first image-forming device of the invention as described above can be added.

A second medium edge part judgment method of the invention uses an image-forming device including an recording means that forms an image on a medium; an optical sensor that outputs an output value in response to existence or non-existence of the medium; a first moving means that is relatively movable for the optical sensor and the medium by moving at least one of the optical sensor and the medium in a predetermined first direction; and a second moving means that is relatively movable for the optical sensor and the medium by moving at least one of the optical sensor and the medium in a second direction, which intersects with the first direction, and the second medium edge part judgment method includes the steps of:

(a) an edge part candidate detection process step that detects an edge part candidate of the medium based on an output change of the optical sensor while the optical sensor and the medium are relatively moved by the first moving means;

(b) an edge judgment process step that judges the edge part candidate as an edge part of the medium when the edge part candidate shall be deemed as a correct edge part based on the detected edge part candidate;

(c) a moving process for a re-detection step that controls the second moving means to relatively move the optical sensor and the medium when the edge part candidate shall be deemed as a correct edge part in the edge part judgment process;

(d) a re-detection step that re-detects an edge part candidate by performing the edge part candidate detection process after the moving process for re-detection; and (e) an edge part judgment process step that performs the edge part judgment process based on the re-detected edge part candidate.

In the first medium edge part judgment method of the invention, when the edge part candidate shall not be deemed as a correct edge part in the edge part judgment process, the optical sensor and the medium are relatively moved to the second direction so that the edge part candidate detection process can be performed in an area different from the previous area in the medium. Thus, for example, even when the previous edge part candidate was a case that the false detection element was detected in the medium, it can be expected that at the time of the re-detection, the edge part candidate detection process is performed in an area where a false detection element is not existed. Because of this, an edge part of the medium can be detected with accuracy although the medium includes a false detection element. By the way, in the second medium edge part judgment method of the invention, various aspects of the second image-forming device of the invention as described above can be employed and also, the steps that realize the respective functions of the second image-forming device of the invention as described above can be added.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
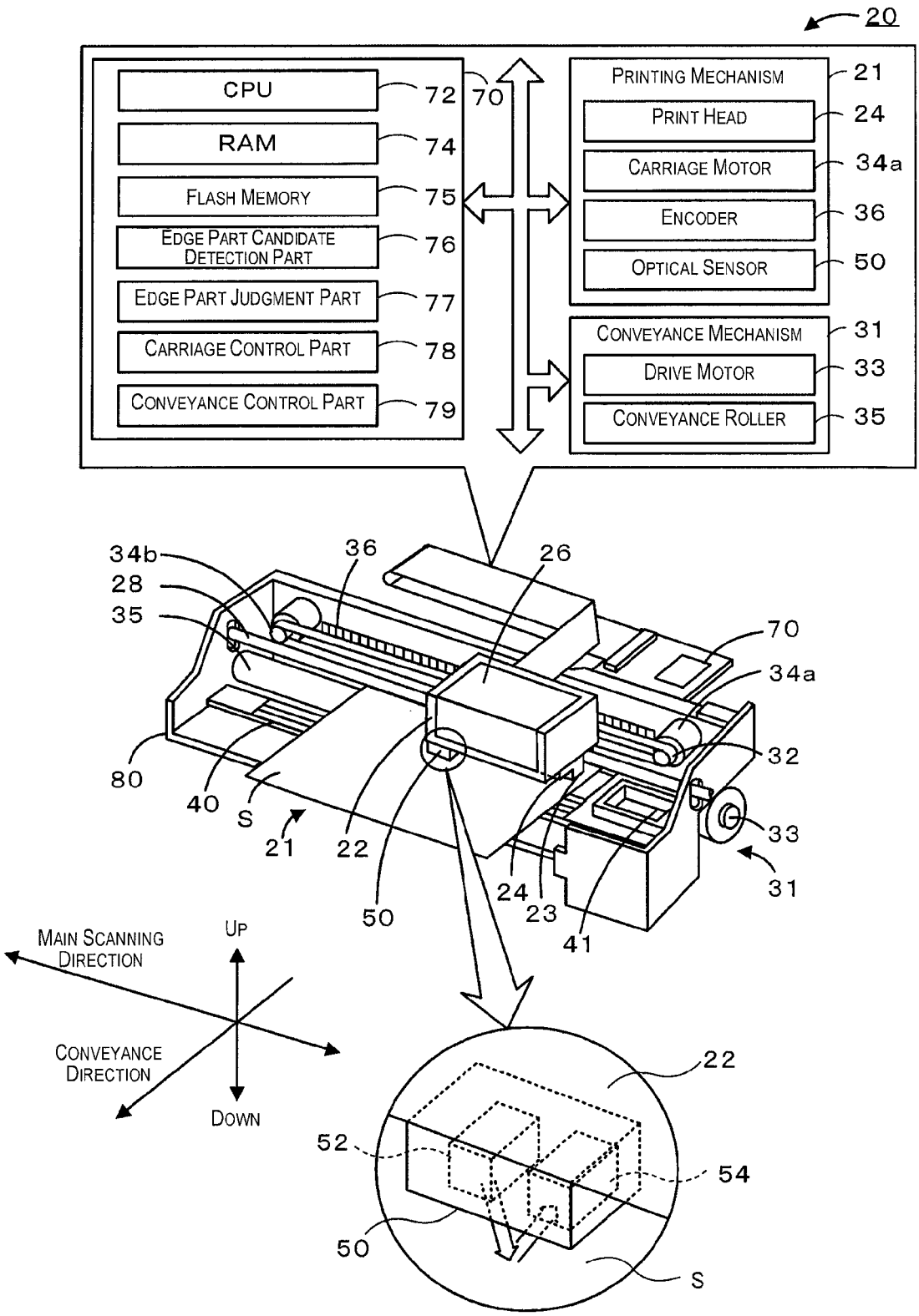
FIG. 1 is a configuration diagram showing schematic configuration of a printer 20 in the present embodiment.

Next, the present embodiment will be explained in reference to the drawings. FIG. 1 is a configuration diagram showing a schematic configuration of the printer 20 according to one embodiment of the first and second image-forming devices. The printer 20 of the present embodiment configures as an inkjet printer, and as shown in FIG. 1, it has a printing mechanism 21 in which a print head 24 discharges ink as liquid on a print medium S (e.g., recording sheet) conveyed on a platen 40, and a conveyance mechanism 31 that conveys the print medium S in a downstream conveyance direction (front from the back of the drawing) so that the print medium S is conveyed through the platen 40 by driving a conveyance roller 35, which is driven by a drive motor 33. Also, the printer 20 has a capping device 41 that seals a printer head 24 formed in the right edge of the platen 40 in the drawing, and a controller 70 that controls entire printer 20. By the way, the upper position of the capping device 56 is called as a home position. The inkjet printer 20 of the present embodiment is usable for a plurality of different size papers such as an A4 paper, an A5 paper, a post card, a Legal size paper, and the like, as the print medium S, and regardless the sizes, these print mediums S are fed (conveyed) in a center of a paper as a standard, which is called as a center paper feeding.

The printing mechanism 21 has a carriage 22 that is reciprocated in a main scanning direction (right and left) along a guide 28 by a carriage belt 32 in accordance with a drive of a carriage motor 34*a*, a print head 24 that forms an image on the print medium S by discharging ink droplet that goes through on the platen 40, and an ink cartridge 26 that supplies ink to the print head 24 that stores each color ink individually. The carriage 22 is moved in the main scanning direction, which intersects with the conveyance direction of the print medium S, by a carriage motor 34*a* that is arranged in the right side of a mechanical frame 80, a driven roller 34*b* that is arranged in the left side of the mechanical frame 80, and a carriage belt 32 that is installed in the carriage motor 34*a* and the driven roller 34*b*. An encoder 36 to detect a position of the carriage 22 is arranged on the back surface of the carriage 22 so that a position of the carriage 22 is manageable by using the encoder 36. In the present embodiment, a position of the carriage 22 is managed by a coordinate of the main scanning direction in a standard as a position of the home position. The ink cartridge 26 installed in the carriage 22 stores each color ink of yellow (Y), magenta (M), cyan (C) and black (K) included with colorant or pigment as a coloring agent to water as a solvent.

The print head 24 is provided in the lower part of the carriage 22, and a voltage is applied to a piezo element such that the piezo element is deformed so that each color ink discharges from a nozzle 23 provided in the lower surface of the print head 24 by a method for applying pressure to the ink. By the way, the print head 24 can employ a method for applying pressure to the ink by applying a voltage to a heat generation resistive element and heating the ink so as to generate air bubble.

An optical sensor 50 that outputs an output value in response to existence or non-existence of the print medium S in the downstream side of the conveyance direction (front side of FIG. 1) comparing to the print head 24 is provided in the lower surface of the carriage 22. As shown in FIG. 1, this optical sensor 50 has a light emitting element 52 (e.g., light emitting diode, or the like) and a light receiving element 54 (e.g., photo-transistor, or the like). By irradiating light from the light emitting element 52 toward the print medium S or the platen 40 and receiving the light reflected from the print medium S or the platen 40 in the receiving element 54, an electric signal of a voltage in response to the light amount is outputted as an output value V. By using different degree of the reflections from the platen 40 and the print medium S, the optical sensor 50 can detect right and left edge parts in the main scanning direction of the print medium S by moving the print medium S thwartwise in accordance with the movement of the main scanning direction of the print medium S. In the present embodiment, for example, the print medium S is a white color and on the other hand, the platen 40 is black, gray, or the like so that such a color has a lower degree of the reflection than the print medium S.

The platen 40 is a member that supports the print medium S conveyed below the print head 24 and the optical sensor 50, and it is formed along the main scanning direction of the print head 24 opposed to the print head 24 and the optical sensor 50 that moves along the guide 28.

The controller 70 is configured as a microprocessor center on the CPU 72, and has a RAM 74 that temporarily stores data or saves data, and a flash memory 75 that stores various processing programs and is rewritable data. An interface (I/F), which is not shown in the drawings, to dialog information with an external device such as, for example, a personal computer, and an input/output port, which is not shown in the drawings, to perform input and output data are connected to the controller 70. A print buffer area is provided in the RAM 74, and an image data transferred from the external device through, for example, the I/F is stored in the print buffer area. Also, the controller 70 has an edge part candidate detection part 76, an edge part judgment part 77, a carriage control part 78, and a conveyance control part 79. The edge part candidate detection part 76 detect more than one change point, which changes an output of the optical sensor 50, while the optical sensor 50 moves in the main scanning direction on the print medium S, and there is a function to perform the edge part candidate detection process to detect an edge part candidate of the print medium S based on the detected change point. The edge part judgment part 77 has a function to perform the edge part judgment process to judge an edge part of the print medium S based on the detected edge part candidate. The carriage control part 78 has a function to move the carriage 22 in the main scanning direction by controlling the carriage motor 34*a*. For example, when the edge part candidate detection part 76 performs the edge part candidate detection process, the carriage control part 78 controls the carriage motor 34*a* so that the optical sensor 50 crosses the print medium S by moving the carriage 22 in the main scanning direction. The conveyance control part 79 has a function to convey the print medium S in the conveyance direction by controlling the drive motor 33 so as to drive the conveyance roller 35. For example, when the edge part judgment part 77 judges an edge part of the print medium S, the conveyance control part 79 performs a moving process for re-detection to convey the print medium S in the downstream side of the conveyance direction as a preprocessing of returning the edge part candidate detection process by the edge part candidate detection part 76. A position signal from the encoder 36 and an electric signal from the optical sensor 50, or the like are inputted to the controller 70 through the input port. Also, a drive signal to the print head 24, the driving motor 33, the carriage motor 34*a*, or the like is outputted from the controller 70 through the output port.

Figure 2:
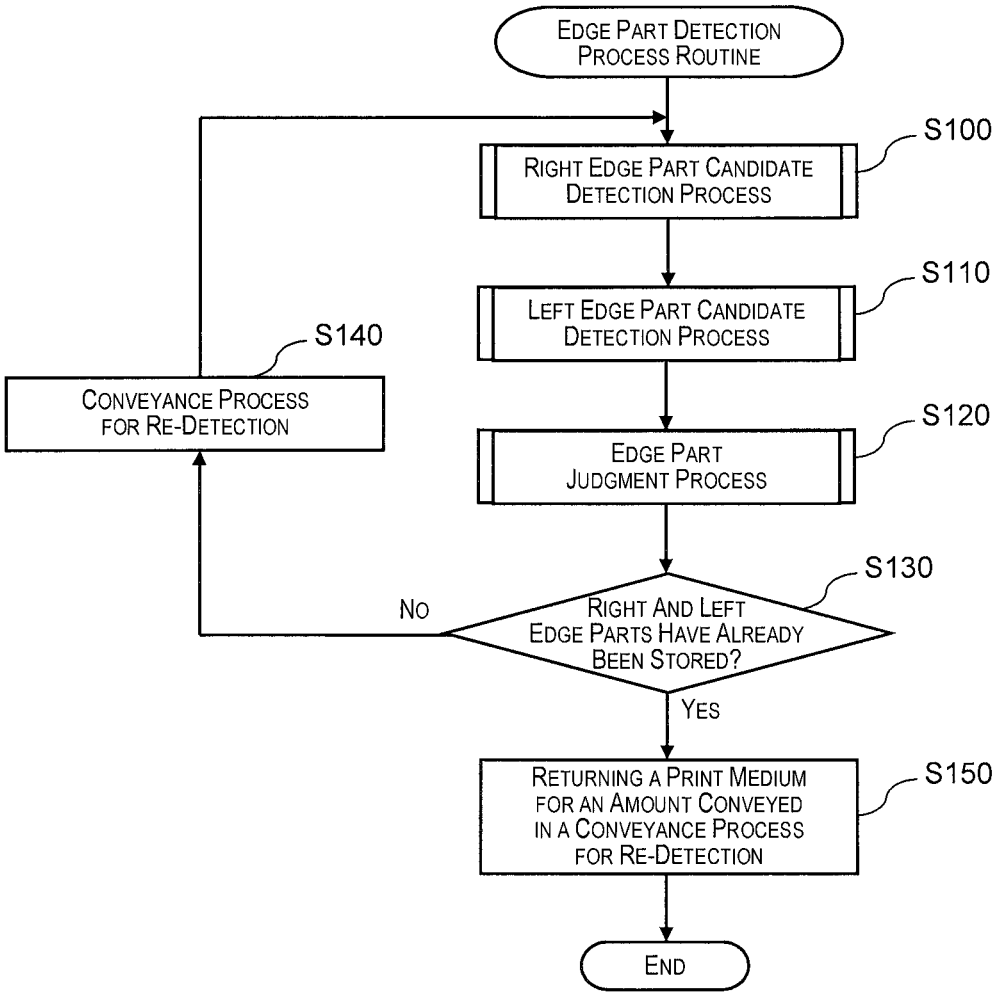
FIG. 2 is a flowchart showing an example of an edge part detection process routine.

Next, the operation of the printer 20 in the configuration of the present embodiment and specifically, the operation when an edge part in the main scanning direction of the print medium S is detected before the print process to form an image on the print medium S will be explained. The printing process starts when the user instructs, for example, the printer 20 to print an image onto the print medium S through the personal computer connected to the printer 20. When the printing is instructed, the controller 70 inputs an image data of a target print from the personal computer through the 1/F, and stores it in the print buffer area of the RAM 74. Also, the conveyance roller 35 is rolled by driving the drive motor 33, and a paper feeding process to convey the print medium S to a print start position on the platen 40 is performed. And, after executing the edge part detection process routine to judge a right edge part and left edge part of the fed print medium S, the printing process is executed to form an image on the print medium S based on the image data. In the printing process, first, a printable area that is an area in the main scanning direction to discharge ink from the print head is set based on the positions of the right edge part and the left edge part of the print medium S judged by the edge part detection process routine. For example, the data for outside of the printable area in the image data is masked by a masking process so as to not print the data. And, the print head 24 and the carriage motor 34*a* are driven to discharge ink from the print head 24 by moving the carriage 22 in a moving range of the main scanning direction based on the print data of one pass, and the print medium S is conveyed for one pass by rotating the conveyance roller 35 every time the print for one pass is ended. By repeating the printing process for the one pass, an image within the printable area of the print medium S is formed, and when the printing of the print medium S of one pass is completed, the print medium S is discharged by rotating the conveyance roller 35. Hereinafter, the detail about the edge part detection process will be explained. FIG. 2 is a flowchart showing an example of the edge part detection process routine. This routine is stored in the flash memory 75 and is executed by the CPU 72 with the edge part candidate detection part 76, the edge part judgment part 77, the carriage control part 78, and the conveyance control part 79.

When the edge part detection process routine is executed, first, the CPU 72 of the controller 70 performs a right edge part candidate detection process to detect a right edge part candidate such as a candidate of an edge part in a right side of the main scanning direction of the print medium S (Step S100). Next, a left edge part candidate detection process is performed to detect a left edge part candidate such as a candidate of an edge part in a left side of the main scanning direction of the print medium S (Step S110), and the edge part judgment process is performed to judge the right edge part and the left edge part of the print medium S based on the detected right edge part candidate and left edge part candidate (Step S120). Hereinafter, the explanation of the edge part detection process routine is interrupted, and the details about the right edge part candidate detection process of Step S100, the left edge part candidate detection process of Step S110, and the edge part judgment process of Step S120 will be explained.

Figure 3:
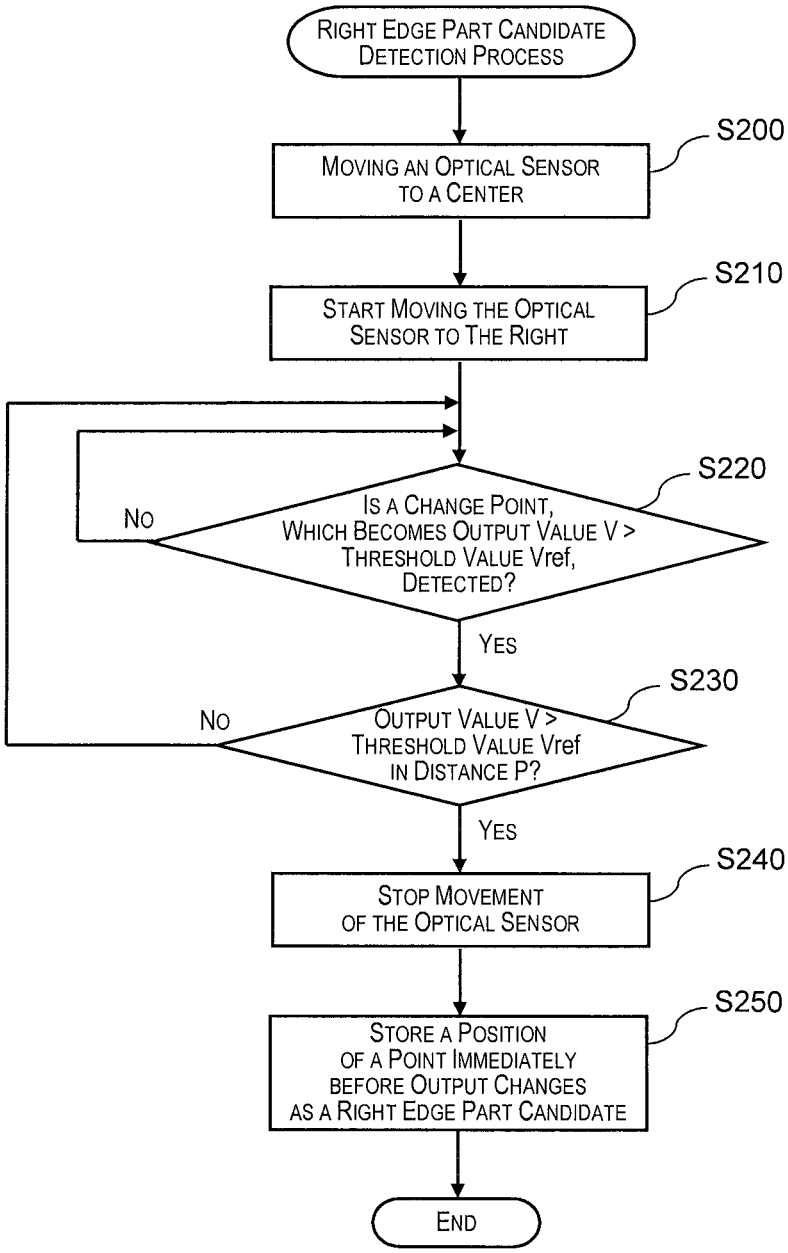
FIG. 3 is a flowchart showing an example of a right side edge part candidate detection process.

First, the right edge part candidate detection process will be explained. FIG. 3 is flowchart showing an example of the right edge part candidate detection process executed by the controller 70. The program of this process is stored in the flash memory 75, and it is executed by the CPU 72 with the edge part candidate detection part 76, and the carriage control part 78. When the right edge part candidate detection process is executed, first, the CPU 72 of the controller 70 moves the carriage 22 so that the optical sensor 50 is located in a central position of the print medium S (Step S200). By the way, as described above, in the printer 20, the print medium S is fed by the center paper feeding so that the central position of the print medium S is fixed regardless the size of the print medium S. Thus, in the present embodiment, the central position (coordinate) of the print medium S is preliminary stored in the flash memory 75, and the carriage 22 is moved so that the optical sensor 50 is located in the central position of the print medium S based on the stored central position.

Next, the CPU 72 controls the carriage 22 to start moving to the right side main scanning direction for the optical sensor 50 (Step S210). And, an output value of the optical sensor 50 is continuously checked during the movement of the optical sensor 50, and it waits until detecting a change point which changes from a condition that the output of the optical sensor 50 indicates existence of the print medium S to a condition that the output of the optical sensor 50 indicates non-existence of the print medium S (Step S220). This process is performed as described below. As described above, a white part of the print medium S has a higher degree of the reflection compare to the platen 40 so that the light amount of the reflection becomes stronger and the output V of the optical sensor 50 becomes smaller. Thus, a predetermined threshold value Vref, which judges stronger and weaker of the reflection light, and the output value V of the optical sensor 50 are compared, and when a condition that the output V of the optical sensor 50 is less than the threshold value Vref is changed to a condition that the output V of the optical sensor 50 exceeds the threshold value Vref, at this point, the position of the optical sensor 50 is detected as a change point. By the way, when the output value V is less than the threshold value Vref, it corresponds to a condition of existence of the print medium S. When the output value V exceeds the threshold value Vref, it corresponds to a condition of non-existence of the print medium S.

When the change point is detected in Step S220, the CPU 72 judges whether or not the output value V of the optical sensor 50 continuously exceeds the threshold value Vref while the optical sensor 50 moves a predetermined distance P from the detected change point to a right side in a main scanning direction (Step S230). Specifically, it judges a condition whether or not the output of the optical sensor 50 continuously indicates non-existence of the print medium S while the optical sensor 50 moves the distance P from the detected change point in the right side main scanning direction. And, when the output V is less than the threshold value Vref while the optical sensor 50 moves a distance P from the change point to the right side in the main scanning direction, it returns to Step S220 and repeats the process. On the other hand, when the output value V exceeds the threshold value Vref while the optical sensor 50 moves a distance P from the change point in the right side main scanning direction, the movement of the optical sensor 50 stops (Step S240) and a position (coordination) at a point immediately before output changes is stored in the RAM 74 as the right edge part candidate of the print medium S (Step S250), and the right edge part candidate detection process ends.

Figure 4:
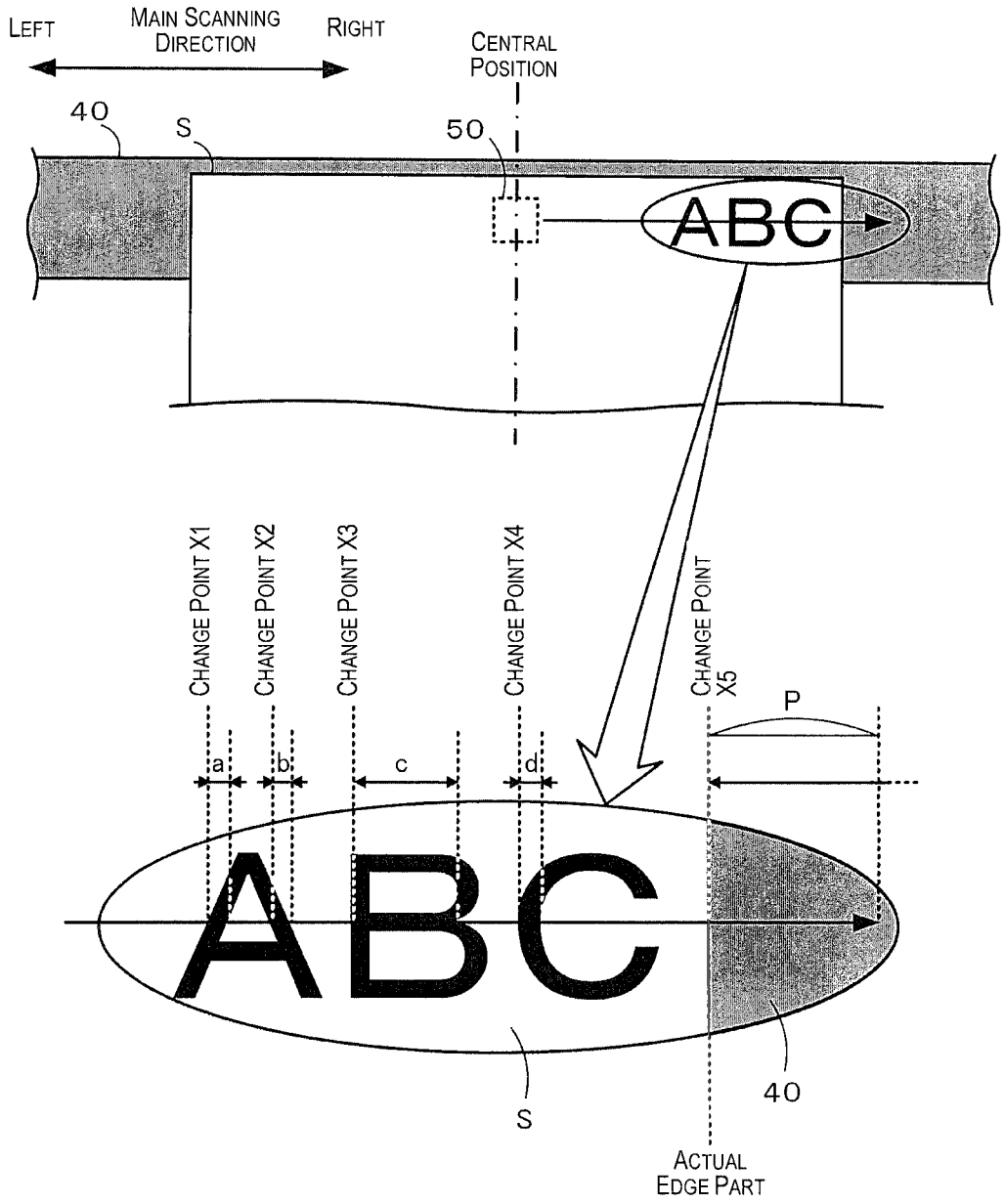
FIG. 4 is an explanatory diagram showing a condition of performing the right side edge part candidate detection process.

FIG. 4 is an explanatory diagram showing a condition of performing the right side edge part candidate detection process. In the right side edge part candidate detection process, as shown in the upper stage of FIG. 4, the optical sensor 50 moves to a central position of the print medium S, and from that position, the optical sensor 50 starts moving to the right side in the main scanning direction (right side in FIG. 4, left side in FIG. 1) so as to detect a change point. At this point, if an image such as, for example, characters is printed on the print medium S, the strength of the reflection light is reduced when the optical sensor 50 moves from a part that the image is not printed on the print medium S to a part that the image is printed so that it is detected as the change point by Step S220. For example, when the optical sensor 50 moves from the central position of the print medium S of FIG. 4 to the right side in the main scanning direction, a change point X1 in an enlarged part of FIG. 4 is detected. However, when the optical sensor 50 further moves from a position of the change point X1, at a point of a moved distance a, the optical sensor 50 reaches to a part that an image is not printed so that the strength of the reflection light becomes high and the output value V becomes less than the threshold value Vref. And, in Step S230, it is judged that the output value V of the optical sensor 50 continuously exceeds the threshold value Vref because the distance a is smaller than the predetermined distance P as shown in the drawing so that it returns to Step S220. After, in the same manner, change points X2, X3, X4 in which images are printed in the print medium S are detected, but these change points can be ignored because the distances b, c, d are respectively smaller than the distance P as shown in the drawing. And, when a change point X5 in which the optical sensor 50 gets across an actual edge part was detected, while the optical sensor 50 moves the predetermined distance P from the change point X5, the optical sensor 50 receives the reflection of the light irradiated to the platen 40 so that the output value V still exceeds the threshold value Vref. Therefore, it proceeds to Step S250 and the point X5 immediately before output changes is stored as the right edge part candidate of the print medium S.

Because of this, in the right side edge part candidate detection process, even if there is a false detection element such as an image in the print medium S and the output of the optical sensor 50 changes, after that, unless a condition that non-existence of the print medium S is indicated continues, the change point is not detected as the right edge part candidate of the print medium S. On the other hand, when the actual edge part of the print medium S was detected as a change point, after the optical sensor moved to outside from the edge part of the print medium S, a condition that non-existence of the print medium S is indicated continues so that it is easy to detect the actual edge part of the print medium S as an edge part candidate. Because of this, while the optical sensor 50 moves the distance P from the change point to the right side in the main scanning direction, by judging whether or not the output of the light sensor 50 continuously indicates non-existence of the print medium S, an edge part of the print medium S having a false detection element is accurately detected. By the way, FIG. 4 is used to explain a case that an image is formed on the print medium S, but in the same manner, for example, there is a case that the print medium S has a punch hole. Specifically, when there is a punch hole, the platen 40 is irradiated so that the strength of the reflection light received by the optical sensor 50 is reduced. Thus, there is a case that a change point is detected in the same manner as the case that an image is formed on the print medium S, but even in this case, the edge part of the print medium S can be accurately detected. Because of this, in the right edge part candidate detection process of the present embodiment, it is not limited to an image or a punch hole so that in the print medium S, even when there is a false detection element such as an element having a different degree of the reflection compare to the print medium S, an edge part of the print medium S can be accurately detected. By the way, when the distance P becomes larger, it improves accuracy because it is difficult to detect a false detection element as a right edge part candidate in the print medium S. When the distance P becomes smaller, a processing time of Step S230 becomes shorter. Thus, with the consideration of these points, for example, the distance P can be empirically defined (e.g., 3 mm, 5 mm, 7 mm, or the like).

Figure 5:
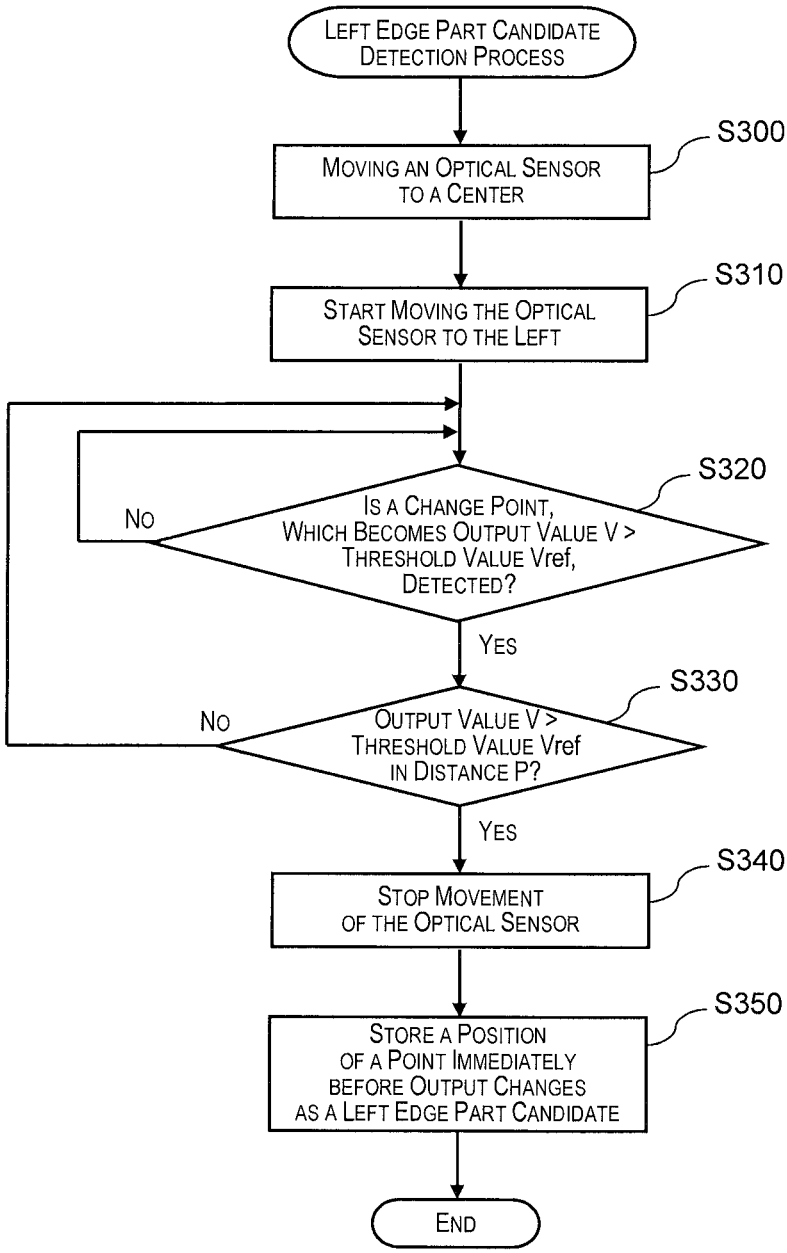
FIG. 5 is a flowchart showing an example of a left side edge part candidate detection process.
Figure 6:
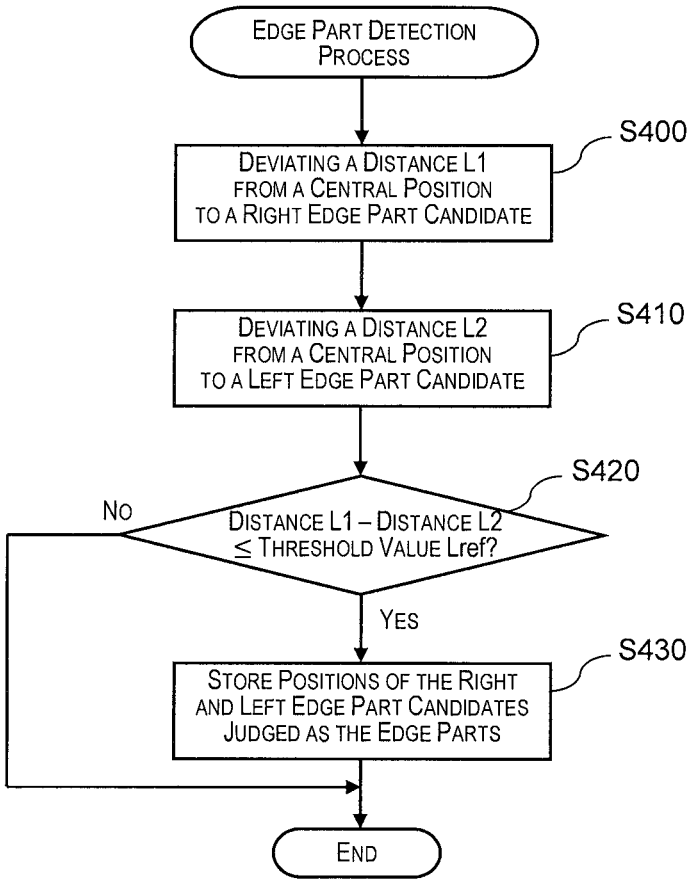
FIG. 6 is a flowchart showing an example of an edge part judgment process.

Next, the detail about the left edge part candidate detection process in Step S110 will be explained. FIG. 5 is a flowchart showing an example of the left edge part candidate detection process executed by the controller 70. The program of this process is stored in the flash memory 75, and it is executed by CPU 72 with the edge part candidate detection part 76, and the carriage control part 78. As shown in the drawing, the left edge part candidate detection process is performed in the same manner as the right edge part candidate detection process other than the point that the optical sensor 50 is moved to the left side in the main scanning direction from the central position of the print medium S. Specifically, when the left edge part candidate detection process is executed, the CPU 72 of the controller 70 moves the carriage 22 so that the optical sensor 50 is located in the central position of the print medium S (Step S300). Next, the CPU 72 controls the carriage 22 to start moving the optical sensor 50 to the left side in the main scanning direction (Step S310). Next, during the movement of the optical sensor 50, the output value of the optical sensor 50 is continuously checked, and it waits until detecting a change point which changes from a case that the output of the optical sensor 50 indicates existence of the print medium S to a case that it indicates non-existence of the print medium S (Step S320). And, while the optical sensor 50 further moves a predetermined distance P from the detected change point to the left side in the main scanning direction, it is judged whether or not the output V of the optical sensor 50 continuously exceeds the threshold value Vref (Step S330), and when the output value V is less than the threshold value Vref while the optical sensor 50 moves the distance P to the left side in the main scanning direction from the change point, it returns to Step S320 and the process repeats. On the other hand, when the output value V continuously exceeds the threshold value Vref while the optical sensor 50 moves the distance P to the left side in the main scanning direction from the change point, the movement of the optical sensor 50 stops (Step S340) and the RAM 74 stores a position (coordinate) at a point immediately before output changes as the left edge part candidate of the print medium S (Step S350). Then, the left edge part candidate detection process ends.

Next, the detail about an edge part judgment process in Step S120 will be explained. The drawing is a flowchart showing an example of the edge part judgment process. The program of this process is stored in the flash memory 75, and it is executed by the CPU 72 with the edge part judgment part 77. When the edge part judgment process is executed, the CPU 72 of the controller 70 derives a distance L1 from the central position of the print medium to the right edge part candidate based on the right edge part candidate stored in Step S250 of the right edge part candidate detection process in FIG. 3 (Step S400). Next, it derives a distance L2 from the central position of the print medium S to the left edge part candidate based on the left edge part candidate stored in Step S350 of the left edge part candidate detection process in FIG. 5 (Step S410). By the way, the distance L1 and the distance L2 are derived as a positive value (absolute value) that does not have any direction. And, it is judged whether or not the difference between the distance L1 and the distance L2 is less than the predetermined threshold value Lref (Step S420). Here, the threshold value Lref is a value to judge whether or not the distance L1 and the distance L2 shall be deemed as an equal, and for example, value 0 or near the value which is acceptable for an error is set. And, when the difference between the distance L1 and the distance L2 is less than the threshold value Lref, that is, the distance L1 and the distance L2 shall be deemed as an equal, the positions of the right edge part candidate and the left edge part candidate are judged as the right edge part and the left edge part of the print medium S so that they are stored in the RAM 74 (Step S430), and the edge part judgment process ends. On the other hand, when the difference between the distance L1 and the distance L2 exceeds the threshold value Lref, that is, the distance L1 and the distance L2 shall not be deemed as an equal, the right edge part and the left edge part are not stored and the edge part judgment process ends.

It returns to the explanation of the edge part detection process routine of FIG. 2. When the edge part judgment process in Step S120 ended, the CPU 72 executes the edge part judgment process of Step S430 so that it judges whether or not the right edge part and the left edge part have been already stored in the RAM 74 (Step S130). And, when the right edge part and the left edge part are not stored in the RAM 74, a conveyance process for re-detection is performed to convey the print medium S to the downstream in the conveyance direction for a predetermined distance F (Step S140), and it returns to and repeats the process of Step S100. Because of this, the conveyance process for re-detection, the right edge part candidate detection process, the left edge part candidate detection process, and the edge part judgment process are repeated until the edge part judgment process of Step S430 is executed the right edge part and the left edge part have been stored in the RAM 74. On the other hand, when the right edge part and the left edge part have been already stored in the RAM 74 in Step S130, the print medium S is returned for the amount conveyed in the conveyance process for re-detection (Step S150), and the present routine ends. For example, the number of the performed conveyance processes for re-detection of Step S140 is stored, and after the conveyance process for re-detection was performed one time, when the right edge part and the left edge part have been already stored by executing the edge part judgment process of Step S430, it conveys the print medium S to the upper stream in the conveyance direction for a distance F. In the same manner, when the conveyance process for re-detection has been performed N times, it conveys the print medium S to the upper stream in the conveyance direction for the distance F×N. When the conveyance process for re-detection has been performed not only one time, the conveyance of the print medium in Step S150 is omitted. In this way, regardless whether or not the conveyance process for re-detection of Step S140 was performed, the position relationship of the carriage 22 and the print medium S in the conveyance direction at the end routine returns to the same condition (a condition at the start time of present routine).

Figure 7:
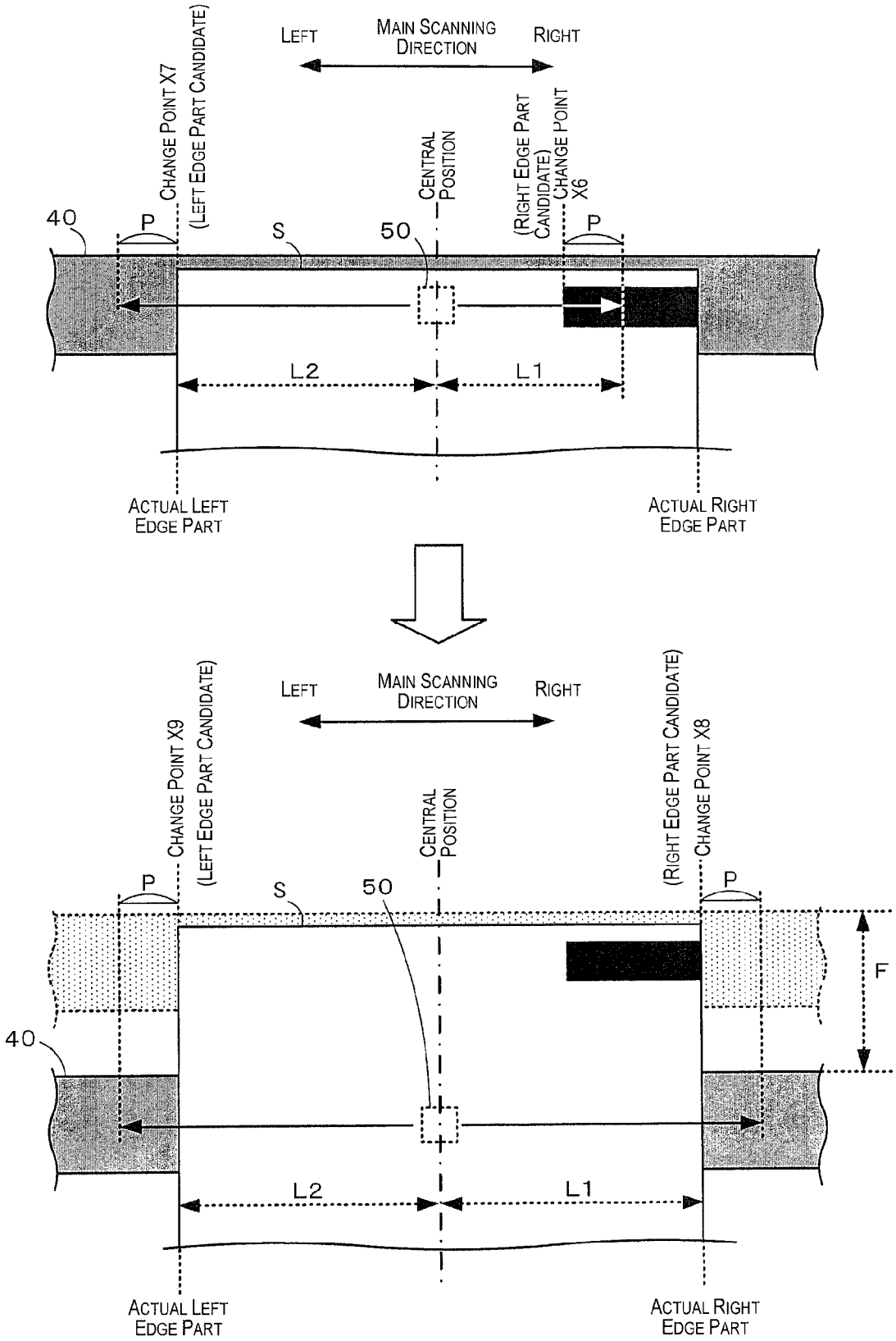
FIG. 7 is an explanatory diagram showing a condition of repeating respective processes by performing a conveyance process for re-detection.

FIG. 7 is an explanatory diagram to explain a condition that the right edge part candidate detection process, the left edge part candidate detection process, and the edge part judgment process are repeated by the conveyance process for re-detection of Step S140. The upper drawing of FIG. 7 is the explanatory diagram showing a condition that the edge part detection process routine was executed and performs the first time of the right edge part candidate detection process, the left edge part candidate detection process, and the edge part judgment process, and the lower drawing of FIG. 7 is the explanatory diagram showing a condition that the second time of the right edge part detection process, the left edge part detection process, and the edge part judgment process after the conveyance process for re-detection was performed. As shown in the drawing, for example, when an image that the width in the main scanning direction is longer than the distance P is formed in the right side of the print medium S, the change point X6, which is detected as an edge part of the image in the print medium S in the first right edge part candidate detection process, is detected as the right edge part candidate. On the other hand, for example, the change point X7, which is detected as an actual left edge part of the print medium S in the first left edge part candidate detection process, is detected as the left edge part candidate. In this case, in the next edge part judgment process, the difference between the distance L1, which is from the central position of the print medium S to the right edge part candidate, and the distance L2, which is from the central position to the left edge part candidate, is larger than the threshold value Lref so that Step S430 does not execute and the right edge part and the left edge part are not stored. Then, the right edge part and the left edge part have not been stored in Step S130 so that it proceeds to Step 140 and the print medium S is conveyed to the downstream in the conveyance direction for the distance F, and the right edge part candidate process, the left edge part candidate detection process, and the edge part judgment process are executed again. In the return right edge part candidate detection process, the right edge part candidate is detected in an area different from the first right edge part candidate detection process by conveying the print medium S for the distance F so that as shown in the lower drawing in FIG. 7, the change point X8, which is detected in an actual right edge part of the print medium S, is detected as the right edge part candidate. And, next, in the return left edge part candidate detection process, the change point X9, which is detected in the left edge part of the print medium S, is detected as the left edge part candidate. In this case, in the next edge part judgment process, the difference between the distance L1, which is from the central position of the print medium S to the right edge part candidate, and the distance L2, which is from the central position to the left edge part candidate, is less than the threshold value Lref so that Step S430 is executed and the right edge part and the left edge part are stored. And, the right edge part and the left edge part have been already stored in the RAM 74 in Step S130 so that the print medium S is conveyed to the upstream in the conveyance direction for the distance F and the edge part detection process routine ends.

Because of this, in the edge part judgment process of the present embodiment, by judging whether or not the difference between the distance L1 and the distance L2 is less than the predetermined threshold value Lref in Step S420, it judges whether or not the right edge part candidate and the left edge part candidate shall be deemed as the proper right edge part and the left edge part of the print medium S, and the edge parts of the print medium S having a false detection element are detected with more accuracy. Also, when the right edge part candidate and the left edge part candidate shall not be deemed as the proper right edge part and the left edge part of the print medium S in the edge part judgment process, the conveyance process for re-detection is performed and then, the re-detection of the edge part candidate and the return edge part judgment process are performed so that it is expected to detect an actual edge part of the medium as a proper edge part candidate by performing the edge part candidate detection process in an area different from previous time at the time of the re-detection. Therefore, the edge parts of the print medium S are detected with more accuracy although the print medium has a false detection element.

Here, the correspondence relation between the configuration elements of the present embodiment and the configuration elements of the invention will be clarified. The print head 24 of the present embodiment corresponds to the recording means, the optical sensor 50 corresponds to an optical sensor, the carriage 22 and the carriage motor 34*a* correspond to the first moving means, the edge part candidate detection part 76 corresponds to the edge part candidate detection means, the edge part judgment part 77 corresponds to the edge part judgment means, the conveyance mechanism 31 corresponds to the second moving means, and the conveyance control part 79 corresponds to the moving control means. By the way, in the present embodiment, by describing the operation of the printer 20, it clarifies one example of the medium edge part judgment method of the invention.

According to the printer 20 of the present embodiment as described above, first, at least one change point, which changes from a condition that an output of the optical sensor 50 indicates existence of the print medium S to a condition indicating non-existence of the print medium S, is detected while the optical sensor 50 moves on the print medium S along the main scanning direction, and when the output of the optical sensor 50 continuously indicates non-existence of the print medium S while the optical sensor 50 further moves the distance P from the detected change point along the main scanning direction, the right edge part candidate detection process and the left edge part candidate detection process to detect the change points immediately before output changes as the right and left edge part candidates of the print medium S. Next, the edge part judgment process is performed to judge the right and left edge part of the print medium S based on the detected right and left edge part candidates. Because of this, the right and left edge parts of the print medium S having a false detection element can be accurately detected. Also, when in the edge part judgment process, the right and left edge part candidates shall not be deemed as the proper right and left edge parts, the print medium S is moved to downstream in the conveyance direction so that the right and left edge part candidates detection process can be performed in an area different from the previous time on the print medium S. Thus, the right and left edge parts of the print medium S having a false detection element can be accurately detected. Furthermore, when the right and left edge parts of the print medium S were judged in the edge part judgment process after the moving process for re-detection, the print medium S is relatively moved for the same moving amount in the opposite direction of the moving process for re-detection so that after the subsequence processes (e.g. print process, and the like) it is not required to judge whether or not a position of the print medium S is changed in the main scanning direction when the right and left edge parts of the print medium S are detected. Because of this, the subsequence process can be efficiently performed. In addition, the right edge part candidate detection process and the left edge part candidate detection process are performed to respectively detect the right and left edge part candidates of the main scanning direction of the print medium S, and the edge part judgment process is performed based on the right and left edge part candidates so that both edge parts of the print medium S can be detected with more accuracy. And, when the respective distances L1, L2 from the central position of the main scanning direction of the print medium S to the both edge part candidates shall be deemed as an equal, the both edge part candidates shall be deemed as the proper right and left edge parts of the print medium S so that it can more properly judge whether or not the right and left edge part candidates are the proper edge parts of the print medium S.

By the way, the invention is not limited to any embodiments described above, and without any implication, it should be practicable in various aspects as long as it belongs to the technical scope of the invention.

For example, in the embodiment described above, in the edge part judgment process in Step S420, by judging whether or not the difference between the distance L1 and the distance L2 is less than the predetermined threshold value Lref, it was judged whether or not the right and left edge part candidates shall be deemed as the proper edge parts of the print medium S. However, it can be any method as long as it is judged whether or not the edge part candidates shall be deemed as the proper edge parts of the print medium S based on the edge part candidates. For example, when the distance between the both edge part candidates shall be deemed as equal to the width of the main scanning direction of the print medium S (in a case that the difference of these is less than the predetermined threshold value), it can be that the edge part candidates of the both edges shall be deemed as the proper right and left edge parts. Alternatively, when the right and left edge part candidates shall be deemed as the same position of the right and left theoretical edge parts of the main scanning direction defined based on the size of the print medium S (it can be a case that the difference of the distance between the edge part candidate and the theoretical edge part is less than a predetermined threshold value), it can be that the edge part candidates of the both edges shall be deemed as the proper right and left edge parts. In these cases, the width of the main scanning direction of the print medium S or the right and left theoretical edge parts of the print medium S can be inputted from, for example, external, or it can be preliminary stored in the flash memory 75 of the printer 20. Also, it can be derived based on the information (e.g., the size or the classification of the print medium S) inputted from external. By the way, it can have a different judgment method in response to the number of repeats in Step S420 such that the first edge part judgment process executed in the edge part detection process routine, and the second time and subsequent edge part judgment processes in Step S420 can have a different judgment method.

In the edge part judgment process in Step S420 as described above, in a case that when the right and left edge part candidates shall be deemed as the same positions with the right and left theoretical edge parts of the main scanning direction defined based on the size of the print medium S, the both edges of the edge part candidates shall be deemed as the proper right and left edge parts of the print medium S, it can judge and store only one of the right and left edge part candidates in Step S420 as the proper edge part. For example, in a case that the right edge part candidate shall be deemed as the same position with the right theoretical edge part, but the left edge part candidate shall not be deemed as the same position with the left theoretical edge part, in the next step of Step S430, the right edge part candidate is judged as the right edge part of the print medium S and it is stored, but the left edge part can not be stored. In this case, Step S140 after the right edge part candidate detection process can be omitted.

In the above described embodiment, in the edge part judgment process in Step S420, by judging whether or not the difference between the distance L1 and the distance L2 is less than the predetermined threshold value Lref, it judges whether or not the right and left edge part candidates shall be deemed as the proper right and left edge parts. However, Steps S400 to S420 can be omitted in the edge part judgment process, and the detected right and left edge part candidates can be judged and stored as the right and left edge parts of the print medium S without any change. Also, Steps S400 to S420 can be omitted in the first edge part judgment process which executes the edge part detection process routine, and Steps S400 to S420 can not be omitted in the second and subsequent edge part judgment process.

In the above described embodiment, the print medium S is fed by the center paper feeding, but it is not limited to this. For example, regardless the size of the print medium S, one edge (e.g., left edge) of the paper can be a reference for a paper feeding, that is, it can be one edge paper feeding. In this case, the central position of the print medium S can be inputted from, for example, external, and it can be derived based on the information (e.g., the size or the classification of the print medium S) inputted from external.

In the above described embodiment, the right edge part candidate detection process and the left edge part candidate detection process were performed, but it can be performed only one of these processes. In this case, Steps S400 to S420 in the edge part judgment process are omitted, and one of the detected edge part candidates can be judged and stored as one of the edge parts of the print medium S without any change. Also, when one of the edge part candidates shall be deemed as the same position as one of the theoretical edge parts of the main scanning direction defined based on the size of the print medium S, it can be determined that one of the edge part candidates shall be deemed as the proper one of the edge parts of the print medium S.

In the above described embodiment, the print medium S was returned for the conveyed amount in the conveyance process for re-detection by executing Step S150, but this process can be omitted.

In the above described embodiment, in the right edge part candidate detection process, the process of Step 230 was performed, but this process can be omitted and the change point detected in Step S220 at first can be stored as the right edge part candidate. In the same manner, Step 330 can be omitted for the left edge part candidate detection process. Also, in the first right edge part candidate detection process and left edge part candidate detection process executed in the edge part process routine, Steps S230 and S330 can be omitted, and in the second and sequence right edge part candidate detection processes and left edge part candidate detection processes after the conveyance process for re-detection of Step 140 was performed, Steps S230 and S330 can not be omitted. In addition, when Step S230 is omitted in the right edge part candidate detection process, in Step S210, it starts moving from the right side, which is much more right than the right edge part of the print medium S in the main scanning direction, to the left side of the optical sensor 50, and the change point which changes from a condition that the output of the optical sensor 50 indicates non-existence of the print medium S to a condition that it indicates existence of the print medium S can be set as the right edge part candidate. That is, in a case that Step S230 is omitted, if the right edge part candidate of the main scanning direction of the print medium S can be detected based on the output change of the optical sensor 50 while the optical sensor 50 moves along the main scanning direction, the right edge part candidate detection process can be performed by any method. Regarding the left edge part candidate detection process in a case that Step 330 is omitted, it can be performed in the same manner as above except left and right are opposite.

In the above described embodiment, when the right edge part and the left edge part are not stored in the RAM 74 in Step S130, the conveyance process for re-detection was performed to convey the print medium S to the downstream in the conveyance direction for the predetermined distance F, but it is not limited to this process. For example, when the right edge part and the left edge part are not stored in the Ram 74 in Step S130, the conveyance process for re-detection can not be performed and an error message can be sent to the user. Also, as described above, the positions of the right and left theoretical edge parts of the main scanning direction defined based on the size of the print medium S can be stored in the RAM 74 as the right and left edge parts of the print medium S. Also, when the number of repeats of the right edge part candidate detection process, the left edge part candidate detection process, and the edge part judgment process exceeds the predetermined number, an error message can be sent to the user. The positions of the above described theoretical edge parts can be stored in the RAM 74 as the right and left edge parts of the print medium S.

In the above described embodiment, in the right edge part candidate detection process, the optical sensor 50 moved to the central position of the print medium S in Step S200 and the optical sensor 50 started moving toward right side in the main scanning direction. However, it is not limited to the central position and it can be from the inside part toward the outside part of the print medium S so that it starts moving toward right side in the main scanning direction. Also, in the right edge part candidate detection process, the moving start position of the optical sensor 50 in Step S210 can be much more left in the main scanning direction than the left edge part of the print medium S. Because of this, the right edge part candidate of the print medium S can be detected. By the way, regarding the left edge part candidate detection process, it can be performed in the same manner as above except left and right are opposite.

In the above described embodiment, the coordinate of the change points that the home position is taken as a reference position was stored as the right and left edge part candidates or the right and left edge parts, but any position can be taken as a reference position of the coordinate. Also, it is not limited to the coordinate and it can be any information to be stored as the right and left edge part candidates or the right left edge parts. For example, the information indicating a moving amount (a moving time, a moving distance or a control amount of the carriage motor 34*a*, or the like) of the optical sensor 50 in Steps S210 and 310 can be stored as the right and left edge part candidates or the right and left edge parts.

In the above described embodiment, the right and left edge parts of the print medium S were detected by executing the edge part detection process before the printing process, but the edge parts of the print medium S can be detected in a different timing. For example, it can be a case before a printing instruction of an image from the user, a case when the print medium S is inserted in a manual tray, or the like. When the print medium S is detected by a predetermined sensor, the edge parts of the print medium S can be detected by executing the edge part detection process routine. Or, the edge part detection process routine can be executed during the printing for one pass by the print head 24. In this case, Steps S200, S210, S300, and S310 of the right edge part candidate detection process or the left edge part candidate detection process are omitted, and the right edge part candidate and the left edge part candidate can be detected by performing the right edge part candidate detection process or the left edge part candidate detection process in response to a moving direction of the carriage 22 by printing. Also, only one of the right edge part candidate and the left edge part candidate can be detected.

In the above described embodiment, the edge parts of the main scanning direction of the print medium S were detected by the optical sensor 50, but a downstream edge (front side of the edge part in FIG. 1) or an upstream edge (back side of the edge part in FIG. 1) in the conveyance direction of the print medium S can be detected. In this case, for example, a process to relatively move the optical sensor 50 from the inside of the print medium S to outside of the conveyance direction (e.g., downstream side in the conveyance direction) by the conveyance mechanism 31 instead a processes of Steps S300 and S310 in the left edge part candidate detection process.

In the above described embodiment, in the optical sensor 50, as a light amount of the received reflection light is larger, the output value V becomes smaller. However, it can be that as a light amount of the received reflection light is larger, the output value V becomes larger.

In the above described embodiment, the optical sensor 50 was provided in the downstream side in the conveyance direction compare to the print head 24, but it can be provided in upstream side in the conveyance direction compare to the print head 24, or it can be provided in the right side in the main scanning direction.

In the above described embodiment, the optical sensor 50 moved in the main scanning direction with the print head 24 by the carriage 22, but the optical sensor 50 can move in the main scanning direction with a moving means other than the carriage 22 so that the optical sensor 50 and the print head 24 can be separately movable.

In the above embodiment, the optical sensor 50 was movable in the main scanning direction and also the print medium S was movable in the conveyance direction. However, the optical sensor 50 and the print medium S can be relatively movable. For example, both of the optical sensor 50 and the print medium S can be movable in the main scanning direction, or only the print medium S can be movable in the main scanning direction. In the same manner, both the optical sensor 50 and the print medium S can be movable in the conveyance direction, or only the optical sensor 50 can be movable in the conveyance direction.

In the above described embodiment, the printer 20 was configured as the serial printer, but it can be a page printer or a line printer. Specifically, the print head 24 moved in the main scanning direction, but it is not particularly limited to this configuration and it can be that the print head does not move.

In the above described embodiment, the image-forming device of the invention was a single printer 20, but it is not particularly limited to this configuration and it can be a compound device having a scanner, and the like other than the printing mechanism 21, or it can be a FAX, and the like. Also, the invention was explained in an aspect of the printer 20, but it can be explained in an aspect of a medium edge part detection method.

What is claimed is:

1. An image-forming device comprising:

a recording means that forms an image on a medium;

an optical sensor that outputs an output value in response to existence or non-existence of the medium;

a first moving means that is relatively movable for the optical sensor and the medium by moving at least one of the optical sensor and the medium in a predetermined first direction;

an edge part candidate detection means that performs an edge part candidate detection process to detect at a point immediately before output changes as an edge part candidate of the medium when more than one change point, which changes from a condition that the output of the optical sensor indicates an existence of the medium to a condition that the output of the optical sensor indicates a non-existence of the medium while the optical sensor and the medium are relatively moved by the first moving means, is detected, and the output of the optical sensor continuously indicates non-existence of the medium while the optical sensor and the medium relatively move for a predetermined moving amount from the detected change point along the first direction; and an edge part judgment means that performs an edge part judgment process to judge an edge part of the medium based on the detected edge candidate.

2. The image-forming device according to claim 1, wherein when the edge part candidate shall be deemed as a correct edge part based on the edge part candidate, the edge part judgment means performs a process to judge the edge part candidate as the edge part of the medium.

3. The image-forming device according to claim 2, wherein the edge part candidate detection means respectively detects both edges of the edge part candidates in the first direction of the medium, and when the both edges of the edge part candidates shall be deemed as correct edge parts based on the detected both edges of the edge part candidates, the edge part judgment means judges the both edges of the edge part candidates as the both edges of the edge parts of the medium.

4. The image-forming device according to claim 3, wherein when respective distances from a predetermined central position of the first direction of the medium to the both edges of the edge part candidates shall be deemed as an equal, the edge part judgment means judges that the both edges of the edge part candidates shall be deemed as correct edge parts of the medium.

5. The image-forming device according to claim 3, wherein when a distance of the both edges of the edge part candidates shall be deemed as an equal to a width in the first direction of the medium, the both edges of the edge part candidates shall be deemed as correct edge parts of the medium.

6. The image-forming device according to claim 2, wherein when the edge part candidate shall be deemed in the same position as a predetermined theoretical edge part defined based on a size of the medium, the edge part judgment means judges that the edge part candidate shall be deemed as a correct edge part of the medium.

7. The image-forming device according to claim 1, further comprising: a second moving means that is relatively movable for the optical sensor and the medium by moving at least one of the optical sensor and the medium in a second direction, which intersects with the first direction; and a moving control means that performs a moving process for re-detection to control the second moving means so as to relatively move the optical sensor and the medium when the edge part candidate shall not be deemed as a correct edge part in the edge judgment process;

wherein the edge part candidate detection means is a means to re-detect the edge part candidate by performing the edge part candidate detection process after the moving process for re-detection; and the edge part judgment means is a means to perform the edge part judgment process based on the re-detected edge part candidate.

8. The image-forming device according to claim 7, wherein when the edge part of the medium was judged in the edge part judgment process after the moving process for re-detection, the moving control means relatively moves the optical sensor and the medium in an opposite direction of the moving direction of the moving process for re-detection and moves in the same moving amount of the moving process for re-detection.

* * * * *